US007455275B1

(12) United States Patent
Astadan et al.

(10) Patent No.: US 7,455,275 B1
(45) Date of Patent: Nov. 25, 2008

(54) PORTABLE COLLAPSIBLE ARTISTS EASEL APPARATUS

(76) Inventors: Eric Astadan, 11575 Meadow St., Moorpark, CA (US) 93021; Bismarck Datuin, 28341 Roman Ct., Saugus, CA (US) 91350

( * ) Notice: Subject to any disclaimer, the term of this patent is extended or adjusted under 35 U.S.C. 154(b) by 0 days.

(21) Appl. No.: 11/158,421

(22) Filed: Jun. 22, 2005

(51) Int. Cl.
*A47B 19/00* (2006.01)

(52) U.S. Cl. ..... 248/441.1; 248/447; 248/460; 248/461; 248/463; 248/165; 312/231

(58) Field of Classification Search ..... 248/441.1, 248/447, 448, 449, 460, 461, 463, 129, 165, 248/166, 444, 464, 465, 163.1, 168, 220.21, 248/222.52; 312/231, 280, 281, 294; 280/47.131, 280/47.27, 47.33, 47.2
See application file for complete search history.

(56) References Cited

U.S. PATENT DOCUMENTS 2,751,271 A * 6/1956 Dessertenne et al. ..... 312/231
4,149,763 A * 4/1979 Delahaie ..... 312/231
4,372,630 A * 2/1983 Fuhri ..... 312/231
4,453,470 A * 6/1984 Capella ..... 108/26
5,399,009 A * 3/1995 Hiner ..... 312/231
6,012,696 A * 1/2000 Borie ..... 248/461
6,308,925 B1 * 10/2001 Wilcox ..... 248/463
6,745,988 B2 * 6/2004 Gelfand ..... 248/460
6,772,987 B2 * 8/2004 Jones, II ..... 248/464
7,118,084 B2 * 10/2006 Park ..... 248/460

* cited by examiner

*Primary Examiner*—J. Allen Shriver
*Assistant Examiner*—Todd M. Epps
(74) *Attorney, Agent, or Firm*—Sturm & Fix LLP

(57) ABSTRACT

A portable, collapsible artist's easel apparatus (10) including a framework member (20) that pivotally supports a compartmented receptacle member (40) equipped with at least one easel tray (45) that may be disposed in a cantilevered fashion relative to the receptacle member (40) wherein, a pair of extensible leg members (25) (26) are pivotally connected to the framework member (20) which is further associated with a pair of flange elements (60) (60) which are pivotally connected to a rear leg member (29) and a canvas support unit (13).

15 Claims, 5 Drawing Sheets

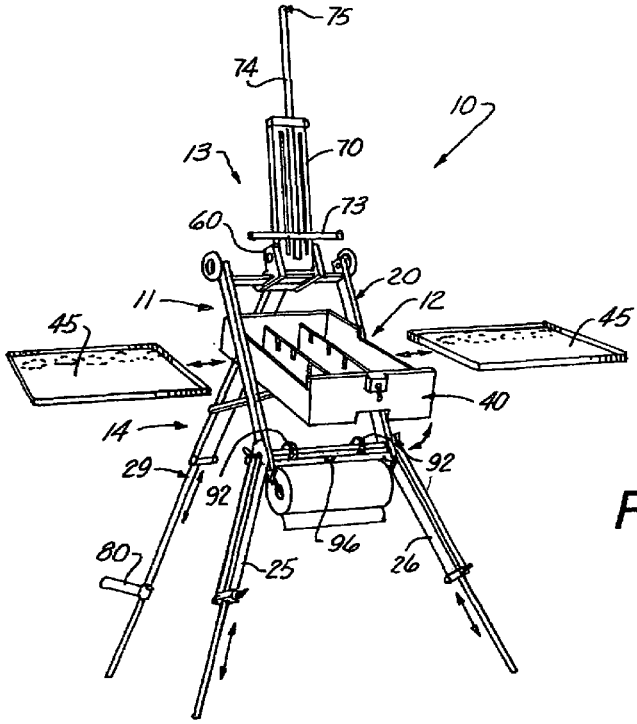
Fig. 1
Fig. 2
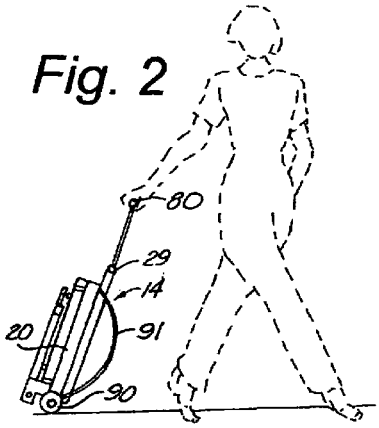
Fig. 3
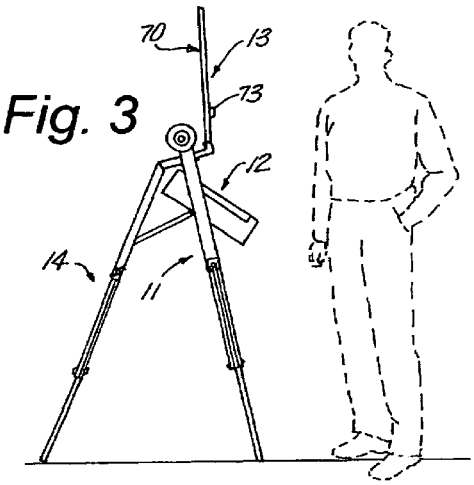

Fig. 9
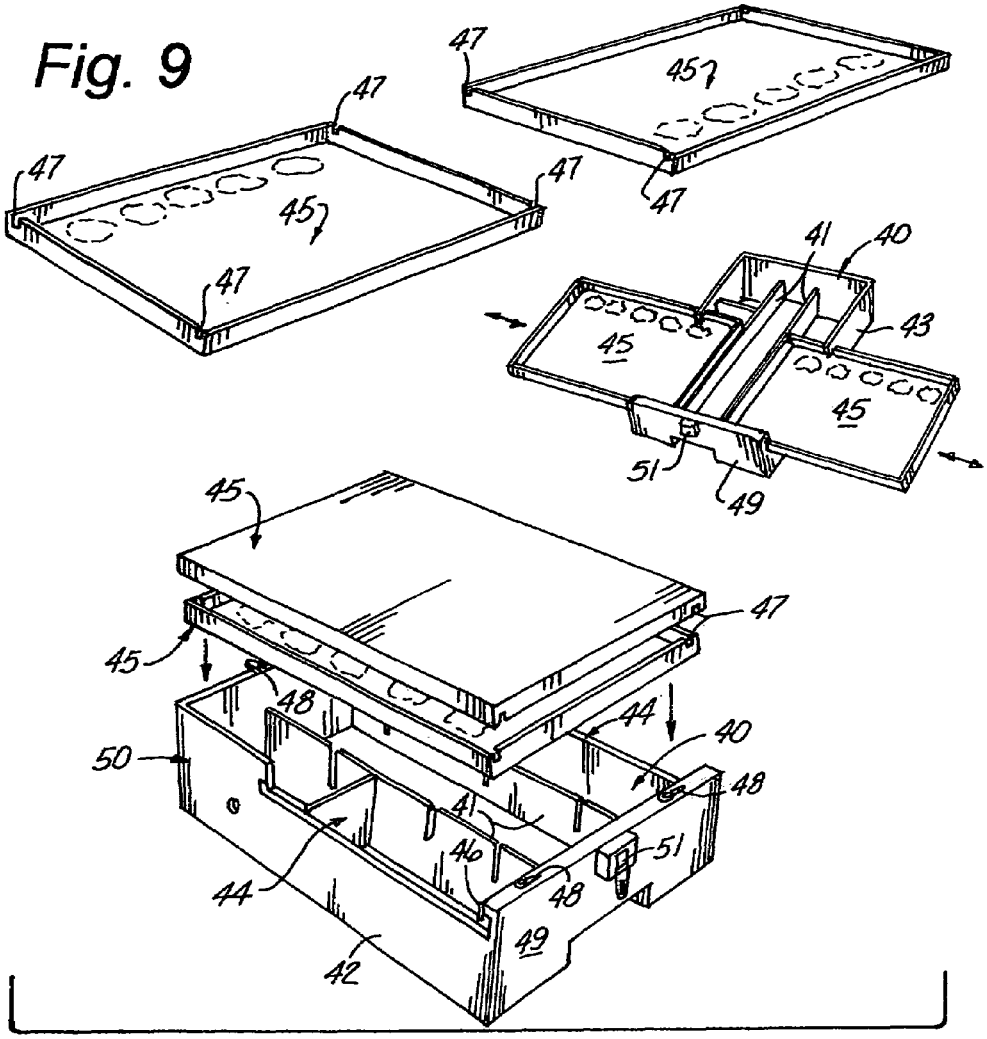
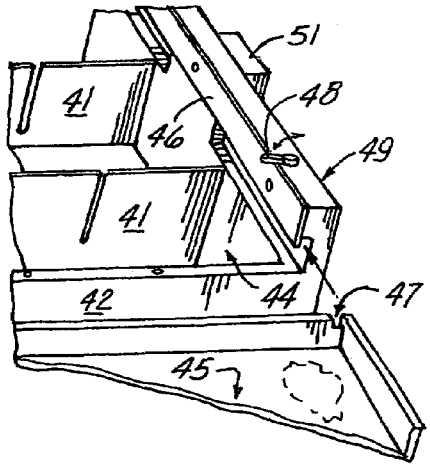
Fig. 10

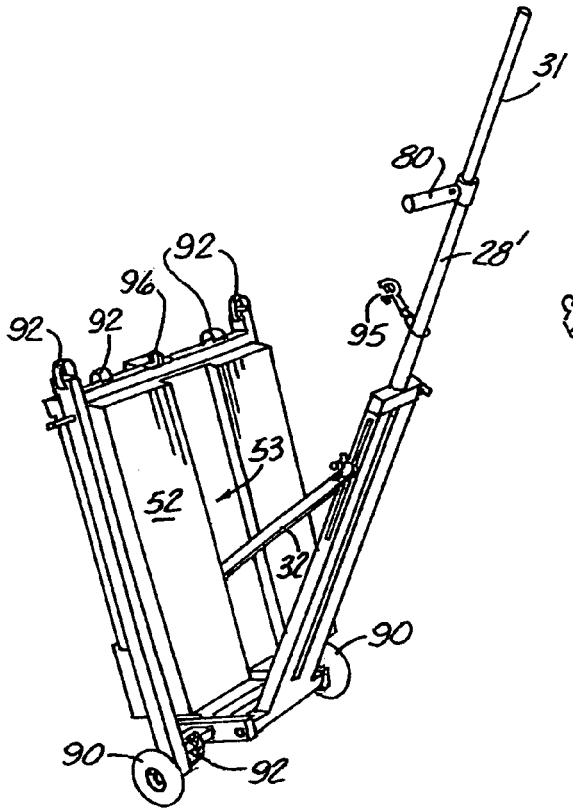
Fig. 11
Fig. 12
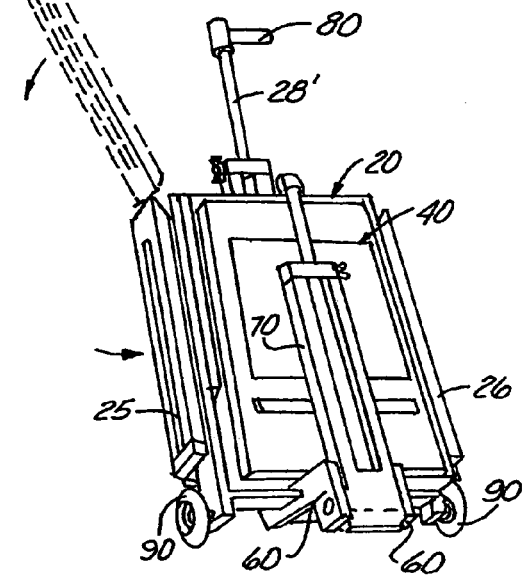
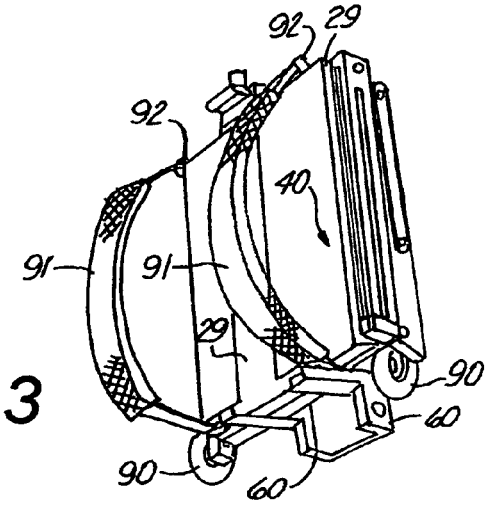
Fig. 13

PORTABLE COLLAPSIBLE ARTISTS EASEL APPARATUS

CROSS REFERENCE TO RELATED APPLICATIONS

Not applicable.

BACKGROUND OF THE INVENTION

1. Field of the Invention

The present invention relates to the field of artists easel constructions in general and in particular to a wheeled, self-contained, portable, collapsible artist's easel construction.

2. Description of Related Art

As can be seen by reference to the following U.S. Pat. Nos. 5,399,009; 4,149,763; 4,372,630; 4,453,470; and, 6,308,925, the prior art is replete with myriad and diverse collapsible easel devices.

While all of the aforementioned prior art constructions are more than adequate for the basic purpose and function for which they have been specifically designed, they are uniformly deficient with respect to their failure to provide a simple, efficient, and practical wheeled, self-contained, portable, and collapsible artist's easel construction having a number of unique structural and functional features.

As most artists are well aware, there are many times when an artist will be required to transport a canvas that they are working on to a remote location such as to art classes and/or while working outdoors painting landscapes, seascapes or the like.

As a consequence of the foregoing situation, there has existed a longstanding need among artists for a new and improved portable, collapsible easel apparatus that can transport multiple canvases and all necessary art supplies from one location to another in a simple, safe and secure manner; and the provision of such an arrangement is the stated objective of the present invention.

BRIEF SUMMARY OF THE INVENTION

Briefly stated, the easel that forms the basis of the present invention comprises in general a framework unit, a convertible storage unit and a transport unit that are operatively associated with the framework unit which further includes a plurality of extensible and/or articulated leg members.

As will be explained in greater detail further on in the specification, all of the leg members are pivotally associated with the framework unit which further pivotally supports the convertible storage unit that includes a compartmented receptacle member having slotted sides that captively yet releasably engage one or more lipped pallette trays that are adapted and dimensioned to be stored within the receptacle member when not in use.

Furthermore, two of the extensible leg members are pivotally disposed on opposite sides of the framework member the bottom surface of the receptacle member of which is provided with a centrally disposed longitudinal recess that is operatively associated with, and dimensioned to receive, a third leg member having an adjustable angular brace element that allows the receptacle member to be positioned at a desired height and angular orientation.

In addition, the transport unit includes in part a wheel assembly operatively connected to the framework unit which also includes an optional back strap assembly that allows the easel apparatus to be transported in a backpack fashion over rough and/or uneven terrain. The third leg collapses into the longitudinal recess of the receptacle unit and can be converted into a steering or handle bar. The canvas holder carries canvases and adjusts and pivots at different angles.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a partially exploded front perspective view of the easel apparatus in its fully deployed mode;

FIG. 2 is a side elevated view that depicts the apparatus in its collapsed mode;

FIG. 3 is a side elevation view that depicts the apparatus in its fully deployed mode;

FIG. 9 depicts the various orientations that the palette trays may assume relative to the receptacle member;

FIG. 10 is an isolated detail view of the sliding engagement between a palette tray and one of the slotted sides of the receptacle member;

FIG. 11 shows the third leg/handle member partially collapsed relative to the bottom panel of the receptacle member;

FIG. 12 shows how the side legs collapse for transport position;

FIG. 13 depicts the position of the handle member relative to the receptacle member when the back strap assembly is employed.

DETAILED DESCRIPTION OF THE INVENTION

Figure 4:
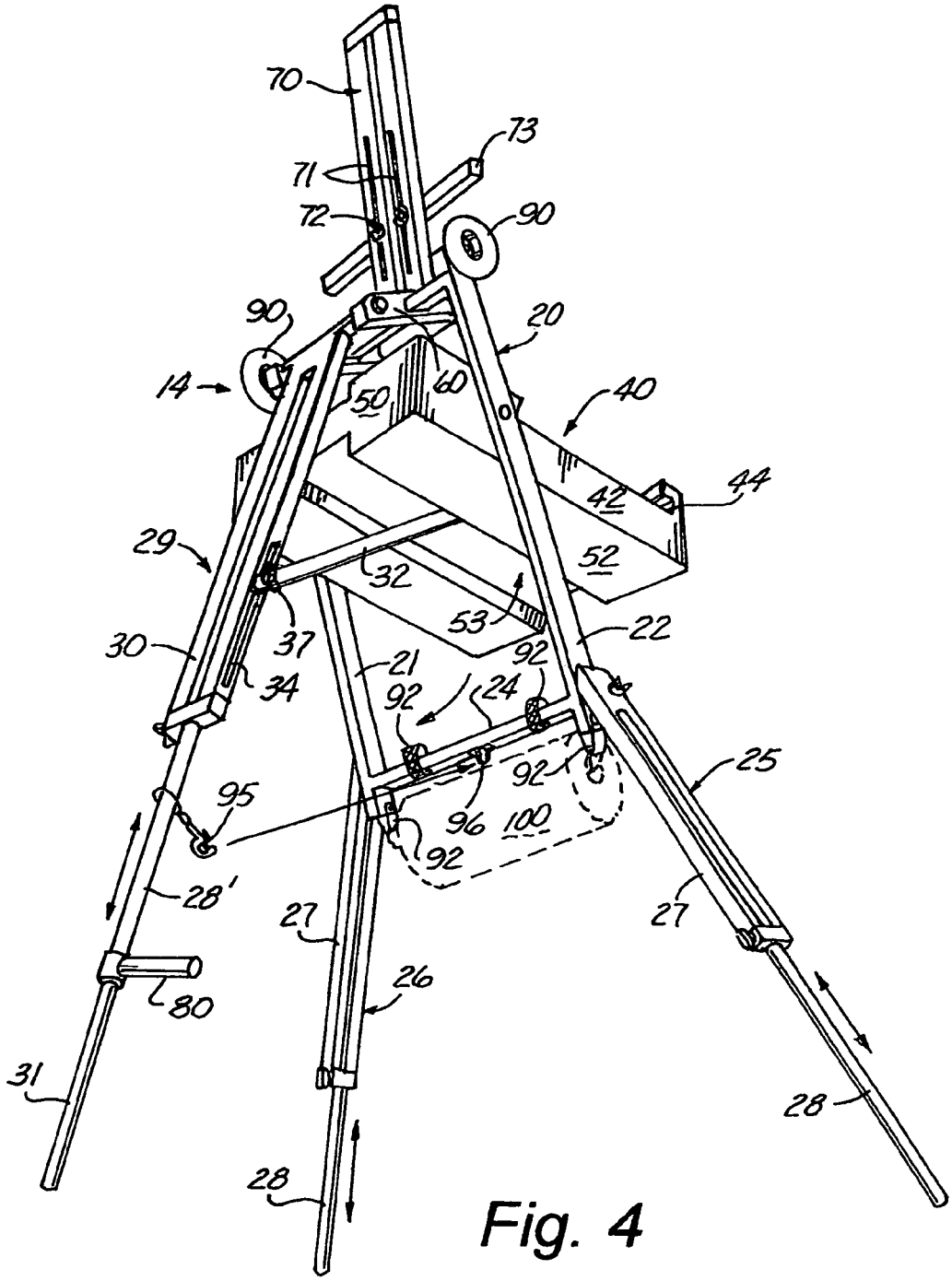
FIG. 4 is a rear perspective view of the easel apparatus in the fully deployed mode.

As can be seen by reference to the drawings, and in particular to FIGS. 1 through 3, the portable and collapsible easel apparatus that forms the basis of the present invention is designated generally by the reference number 10. The apparatus 10 comprises in general a framework unit 11, a storage unit 12, a canvas support unit 13, and a transport unit 14. These units will now be described in seriatim fashion.

Figure 5:
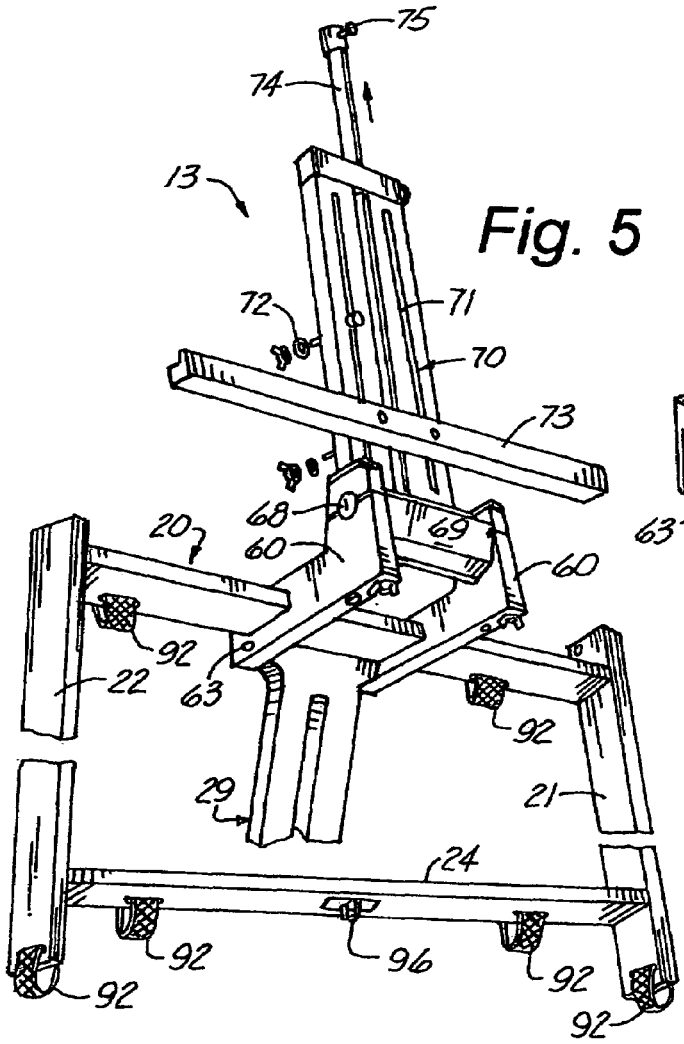
FIG. 5 is an isolated detail view of the combined canvas engagement and handle member.

As shown in FIGS. 1, 4, and 5, the framework unit 11 comprises a generally rectangular framework member 20 having a pair of elongated sides 21 22 that extend beyond the upper 23 and the lower 24 cross-arms wherein, the purpose and function of the outwardly extending portions of the elongated sides 21 22 will be explained in greater detail further on in the specification.

In addition, each of the elongated sides 21 22 of the framework member 20 is provided with extensible leg members 25 26 wherein, each of the adjustable leg members 25 has an upper hollow portion 27 which is pivotally connected to the elongated sides 21 22 of the framework 20 proximate to the lower cross-arm 24 and dimensioned to slidably receive a lower leg extension element 28.

Turning now to FIGS. 1, 4, 9 and 10, it can be seen that the storage unit 12 comprises a compartmented receptacle member 40 pivotally secured to the interior surface of the sides 21 22 of the framework member 20 wherein, the interior of the receptacle member 40 is provided with a plurality of partitions 41 to define individual storage compartments.

Furthermore, as can best be seen by reference to FIGS. 9 and 10, each of the upper portions of the opposed sides 42 43 of the receptacle member 40 is provided with an elongated slot 44 dimensioned to slidably receive one of a pair of raised lip easel trays 45 wherein, the slots 44 are further provided with at least one downwardly depending tang 46 that can slidably engage notches 47 formed on the corners of the easel trays 45 to maintain them in a cantilevered position relative to the receptacle member 40.

In addition, it can be seen that both of the easel trays 45 are dimensioned to rest on top of the partitions 41 in the receptacle member 40 and to be captively engaged relative thereto by a plurality of pivoted catch arms 48 disposed on top of the front 49 and rear 50 walls of the receptacle member 40 wherein, the easel trays 45 45 serve as a lid for the receptacle member 40 in their stored position and the front wall 49 of the receptacle member 40 is further provided with a latch element 51 the purpose and function of which will be explained in greater detail further on in the specification.

As shown in FIGS. 4, 9, and 11, the bottom 52 of the receptacle member 40 is provided with a centrally disposed longitudinal recess 53 that is dimensioned to receive the upper portion 30 of a third extensible rear leg member 29 which forms a part of the transport unit 14.

Turning now to FIGS. 1, 5, 6, and 12, it can be seen that the canvas support unit 13 includes a pair of generally L-shaped split flange elements 60 60 wherein, the lower portion of each flange element 60 is provided with: a slot 61 dimensioned to receive the upper cross-arm 23 of the framework member 20, a discrete aperture 62 dimensioned to receive a first pivot rod 63, and a semi-circular recess 64 dimensioned to cooperate with a complementary semi-circular recess 65 in the upper portion of each flange element 60.

Figure 6:
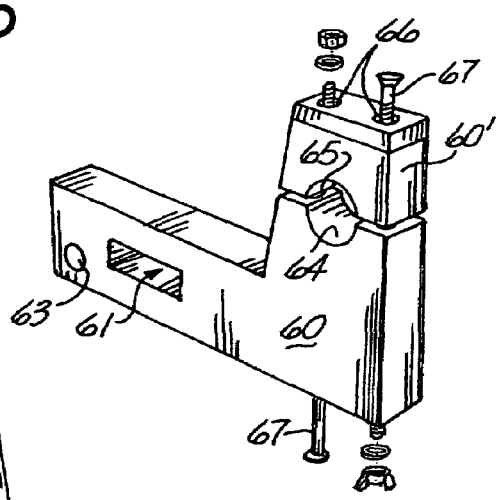
FIG. 6 is an isolated detail view of one of the hinge plates that adjustably positions the canvas engagement and handle member relative to the framework member.

Furthermore, as shown in FIG. 6, the upper portion 60' of each flange element 60 is provided with apertures 66 that extend into the main body of the flange element 60 and are dimensioned to receive elongated fastening elements 67 to allow the flange elements 60 to pivotally and/or captively engage a pivot rod 68 that is operatively connected to the base 69 of an extension arm member 70 as depicted in FIG. 5.

Returning once again to FIGS. 1, 4, and 5, it can be seen that the extension arm member 70 is provided with a pair of elongated slots 71 adapted to receive conventional securing means 72 that allow a recessed canvas support ledge 73 to be adjustably positioned on the extension arm member 70.

As can also be seen by reference to FIGS. 1 and 5, the extension arm member 70 is further designed to telescopically receive an extension rod 74 having a catch element 75 is adapted to rest on, and captively engage the top of, an artist's canvas (not shown) when the bottom of the canvas rests on the canvas support ledge 73.

As can best by seen in particular by reference to FIGS. 4, 5, 7, 8 and 11, the upper portion 30 of the extensible rear leg member 29 is pivotally connected at 63 to the outboard end of the L-shaped flange elements 60 and is dimensioned to slidably receive an extension leg element 28' that further telescopically receive an extension rod element 31 wherein, the position of the extension rod element 31 relative to the extension leg element 28' is controlled by a locking handle member 80 the purpose and function of which will be described presently.

Furthermore, the third leg member 29 is dimensioned to be received in the recess 53 in the bottom panel 52 of the receptacle member 40 wherein, the operative connection between the third leg member 29 is operatively connected to the receptacle member 40 by an angularly adjustable brace element 32 that is connected to the third leg member 29 via an elongated threaded bolt 33 that passes through an elongated slot 34 in the side of the upper portion of the third leg member 29.

Figure 7:
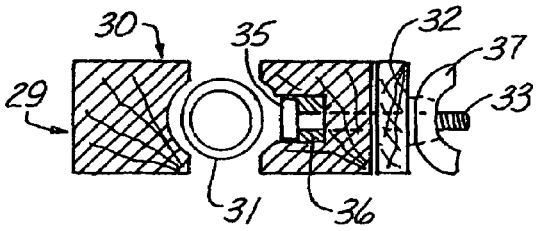
FIG. 7 is a cross-sectional view of the locking mechanism of the angular brace and third leg that allows the receptacle member to be adjusted relative to the angular brace and third leg.
Figure 8:
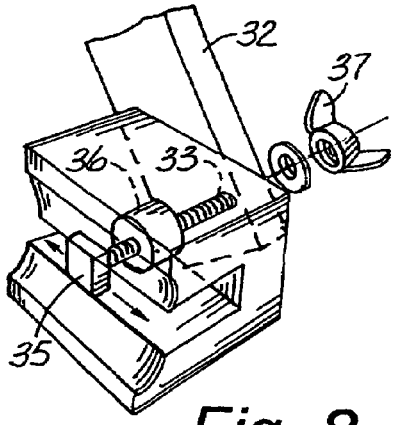
FIG. 8 is an isolated detail view of the engagement of the angular brace element with the third leg member of the apparatus.

In addition, as depicted in FIGS. 7 and 8, the inboard end of the threaded bolt 33 is provided with a brake pad 35 and roller 36 arrangement wherein, the brake pad 35 is adapted to captively engage one side of the extension rod element 31 and the roller 36 is provided to facilitate the sliding movement of the threaded bolt 33 within the slot 34 when a wingnut 37 is loosened on the outboard end of the threaded bolt 33.

The transport unit 14 is best seen by reference to FIGS. 2, 4, 11, and 13, and comprises at least in part a pair of wheel members 90 90 secured to the upper extensions of the sides 21 22 of the framework member 20 wherein, the third leg member 29 and the locking handle member 80 are used to store the apparatus 10 in one mode of transportation as depicted in FIGS. 2 and 11.

In the other mode of transportation depicted in FIGS. 2 and 13, the transport unit 14 also includes a pair of padded shoulder straps 91 attached on their upper and lower ends to a plurality of loops 92 on the framework member 20 wherein, selected ones of the loops 92 may be adapted to support a roll of paper towels, cleaning rags, or the like 100 depicted in phantom in FIG. 4.

It can further be appreciated by reference to FIGS. 4, and 9 through 11, that the third leg member 29 can be releasably secured in the recess 53 in the receptacle member 40 when a snap clip element 95 which is slidably associated with the extension rod element 28' is engaged with the latch element 51 on the receptacle member 40 and the hook element 96 which is located on the lower cross arm 24 on the frame 11.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A portable, collapsible, artist's easel apparatus comprising:

a framework unit including a generally rectangular framework member;

a storage unit including a receptacle member pivotally secured within the framework member, the receptacle member having a bottom panel provided with an elongated recess;

a transport unit including at least in part a pair of wheel members connected to a portion of the framework member;

a plurality of leg members operatively associated with the framework member, the plurality of leg members including a pair of front leg members connected to opposite sides of the framework member and a third rear leg member operatively associated with the framework member, wherein the rear leg member forms at least a portion of the transport unit;

a pair of flange elements connected to a portion of the framework member and pivotally associated with both the rear leg member and an extension arm member; and wherein an upper portion of the rear leg member is matingly received in the elongated recess of the receptacle member, and underlies and supports the receptacle member and framework member, and a lower portion of the rear leg member extends upwardly from the receptacle member forming a handle member when the easel apparatus is in a transport mode.

2. The apparatus as in claim 1 further comprising:

a canvas support unit including the extension arm member operatively associated with the framework member and provided with a vertically adjustable canvas support ledge and further including a catch element adapted to releasably engage the top of an artist's canvas.

3. The apparatus as in claim 1, wherein the receptacle member further includes a plurality of partitions to form interior compartments within the receptacle member which is further dimensioned to receive at least one easel tray that is adapted to form the lid of the receptacle.

4. The apparatus as in claim 3, wherein the receptacle member is further provided with means for supporting said at least one easel tray in a cantilevered fashion relative to the receptacle member.

5. The apparatus as in claim 3, wherein the framework member further includes means for suspending a roll of paper towels relative to the framework member.

6. The apparatus as in claim 5, wherein the receptacle member further includes means for retaining the at least one easel tray in the receptacle lid orientation.

7. The apparatus as in claim 3, wherein the receptacle member further includes means for retaining the at least one easel tray in the receptacle lid orientation.

8. The apparatus as in claim 1, wherein the rear leg member is provided with an extension leg element forming a handle member.

9. The apparatus as in claim 8, wherein the extension leg element telescopically receives an extension rod element.

10. The apparatus as in claim 8, wherein all of the plurality of leg members are extensible and include a hollow upper portion dimensioned to slidably receive an extension leg element.

11. The apparatus as in claim 10, wherein each of the plurality of leg members is provided with means for selectively positioning the extension leg element relative to the hollow upper portion of each leg member.

12. The apparatus as in claim 1, wherein the rear leg member is operatively connected to the recess by an angularly adjustable brace element.

13. The apparatus as in claim 12 further including a pair of strap elements releasably associated with the framework member.

14. The apparatus as in claim 1 further including a pair of strap elements releasably associated with the framework member.

15. The apparatus as in claim 1, wherein the framework member further includes means for suspending a roll of paper towels relative to the framework member.

* * * * *